US006257629B1

(12) United States Patent
Weichelt

(10) Patent No.: US 6,257,629 B1
(45) Date of Patent: Jul. 10, 2001

(54) AUTOMATIC PROCESS AND MACHINE FOR WEAVING ONE CONTINUOUS ROPE

(75) Inventor: Joel Weichelt, 1326 Miller St., Kewaunee, WI (US) 54216

(73) Assignee: Joel Weichelt, Kewaunee, WI (US)

( * ) Notice: Subject to any disclaimer, the term of this patent is extended or adjusted under 35 U.S.C. 154(b) by 0 days.

(21) Appl. No.: 09/522,083

(22) Filed: Mar. 10, 2000

Related U.S. Application Data

(60) Provisional application No. 60/123,844, filed on Mar. 11, 1999.

(51) Int. Cl.[7] ..... B65H 69/04; D04C 1/00

(52) U.S. Cl. ..... 289/1.5; 289/16.5; 87/13; 87/12; 87/53

(58) Field of Search ..... 87/13, 8, 37, 62, 87/12, 53; 289/1.5, 16.5; 66/1 R; 139/11

(56) References Cited

U.S. PATENT DOCUMENTS 3,550,166 * 12/1970 Kotler ..... 5/122
3,592,494 * 7/1971 Pajulaid et al. ..... 289/1.5
3,955,602 * 5/1976 King ..... 139/13 R
4,445,417 * 5/1984 Iijima et al. ..... 87/12
4,615,256 * 10/1986 Fukuta et al. ..... 87/33
4,651,620 * 3/1987 Lyons ..... 87/12
5,273,078 * 12/1993 Kimbara et al. ..... 139/11
5,351,722 * 10/1994 Mamiliano ..... 139/180

* cited by examiner

*Primary Examiner*—John J. Calvert
*Assistant Examiner*—Robert H. Muromoto, Jr.

(57) ABSTRACT

An automatic weaving process for the manufacture of rope hammock beds in which a bobbin of rope passes through loops of rope from the same bobbin resulting in a traditional weave (FIG. 1) from one continuous rope. The process and machine create a woven, open mesh pattern of rope or like materials for forming articles, such as hammocks. The means comprise a frame having a plural set of opposed reciprocal rods, each having a pulley-shaped or like structure mounted on their opposing ends. The frame also supports a means for attaching one end of the rope, and a set ofpulleys to each side centrally, but laterally movable to the rods. The sets of rods, each set comprising rods which are situated in opposing and alternating relationship to the other set of rods, alternately move in and rotate in sequence to capture a portion ofthe rope strung across the center ofthe place of rods, and form an undulating pattern of the rope, through which the supply end of the rope is passed, or "shuttled", back and forth, also in sequence.

1 Claim, 8 Drawing Sheets

AUTOMATIC PROCESS AND MACHINE FOR WEAVING ONE CONTINUOUS ROPE

CROSS-REFERENCE TO RELATED APPLICATIONS

This application is entitled to the benefit of Provisional Patent Application Ser. No. 60-123844.

STATEMENT REGARDING FEDERALLY SPONSORED RESEARCH AND DEVELOPMENT

"Not Applicable"

REFERENCE TO A MICROFICHE APPENDIX

"Not Applicable"

BACKGROUND OF THE INVENTION

This invention relates to an automatic weaving process which could be used for the manufacture of rope hammock beds and other products of the same weave in which a bobbin of rope passes through loops of rope from the same bobbin resulting in the traditional hammock bed weave FIG. 1 from one continuous rope.

Hammock beds have traditionally been made for centuries by hand from one continuous rope. Workers thread a bobbin of rope through each separate weave of the bed. The process of weaving beds by hand is a strenuous job requiring the placing of a 10 to 15 pound bobbin of rope through a predetermined number of loops in each row to form the traditional hammock bed weave FIG. 1. Workers are many times bothered by carpal tunnel disorders as well as other muscular and joint stress. By automating the hand weaving process, the operator is free to work on other processes involved in the production of the hammock while the machine does the strenuous work of weaving the bed. There is a resulting savings not only in the prevention of injuries but a significant savings in labor costs.

The below-referenced U.S. patents, disclose embodiments that were at least in-part satisfactory for the purposes for which they were intended. The disclosures of all the below-referenced prior United States patents, in their entireties are hereby expressly incorporated by reference into the present application for purposes including, but not limited to, indicating the background of the present invention and illustrating the state of the art. The U.S. Pat. Nos. of the references are as follows:

| | |
|---|---|
| 3,550,166 | 5,133,389 |
| 4,112,816 | 5,273,078 |
| 4,170,249 | 5,351,722 |
| 4,512,373 | 5,076,330 |

SUMMARY

A set of opposing rods makes loops in a section of rope and then twists those loops on their sides in such a manner as to form a spiral tube of rope. A bobbin of the same connected rope is then pulled through this tube. The tube section of rope is then dropped leaving a single strand of rope section A second set of rods engages this new section of rope to make the next tube by pulling it apart and pulling the rope into it that had been dropped from the previous set of rods. In this back and forth manner a weave is created from one continuous rope. It creates a weave typical of rope hammock beds traditionally made by hand.

DETAILED DESCRIPTION OF THE INVENTION

Figure 13:
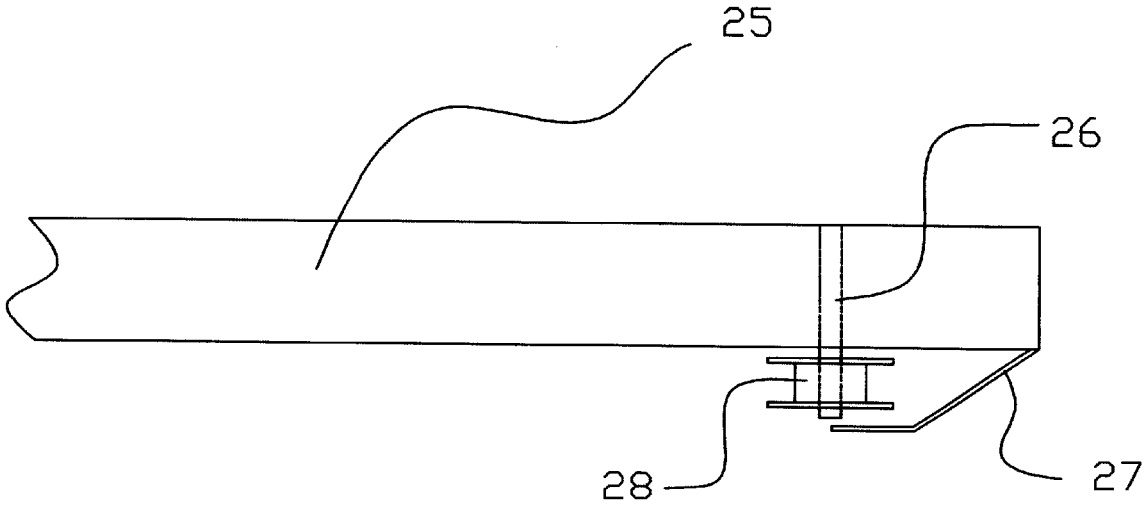
FIG. 13 show the circular capturing devices at the end of each rod.

The operation of the weaving process requires the movement of a forward and a backward cycle. These cycles are repeated as many times as are required for the size hammock bed which is being produced. There is a starting procedure at the beginning of the cycles to set the process up and a removing procedure once the bed is finished. A cycle schedule is included with the drawings which shows the steps on a flow chart. There are two pairs of rod sets 13,14,17, 18. FIG. 13 shows the circular capturing devices at the end of each rod 25. The Capturing devices are composed of a center rod 26 which the roller 28 turns freely on. A rope regulator 27 on each end places to rope into the proper position on the roller and allows the rod 25 to pass with its roller 28 over the top of each rope.

The following is a detailed description ofthe preferred starting procedure, forward and backward cycles and the removing procedure. It describes which parts move and what each part is doing when it moves.

Starting Procedure

Figure 1:
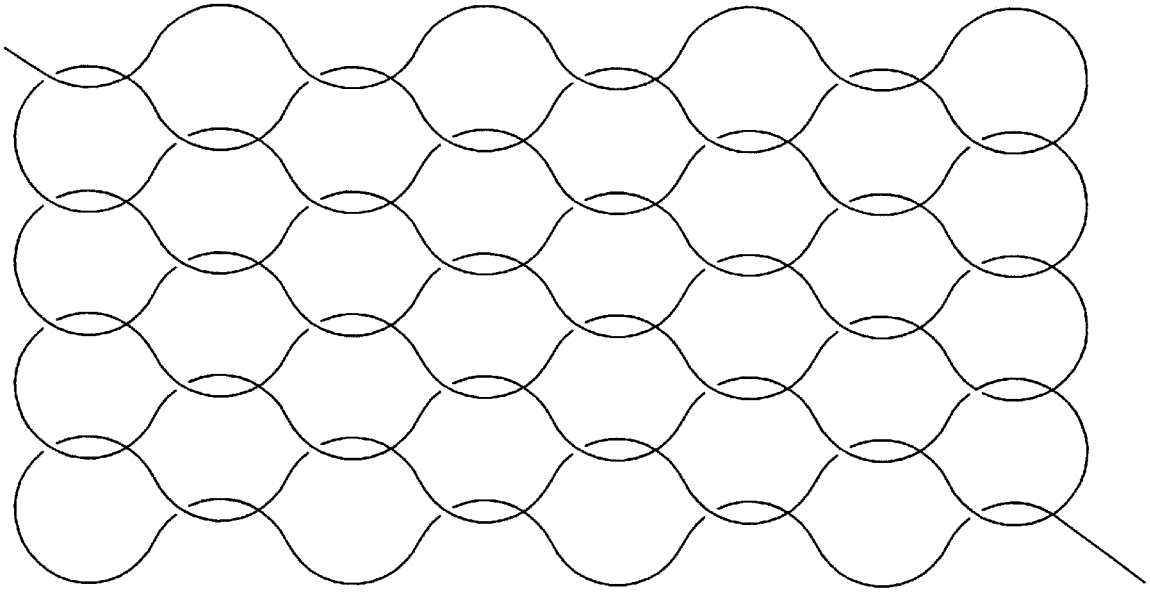
FIG. 1 is a schematic of the traditional weave of a rope hammock bed.
Figure 2:
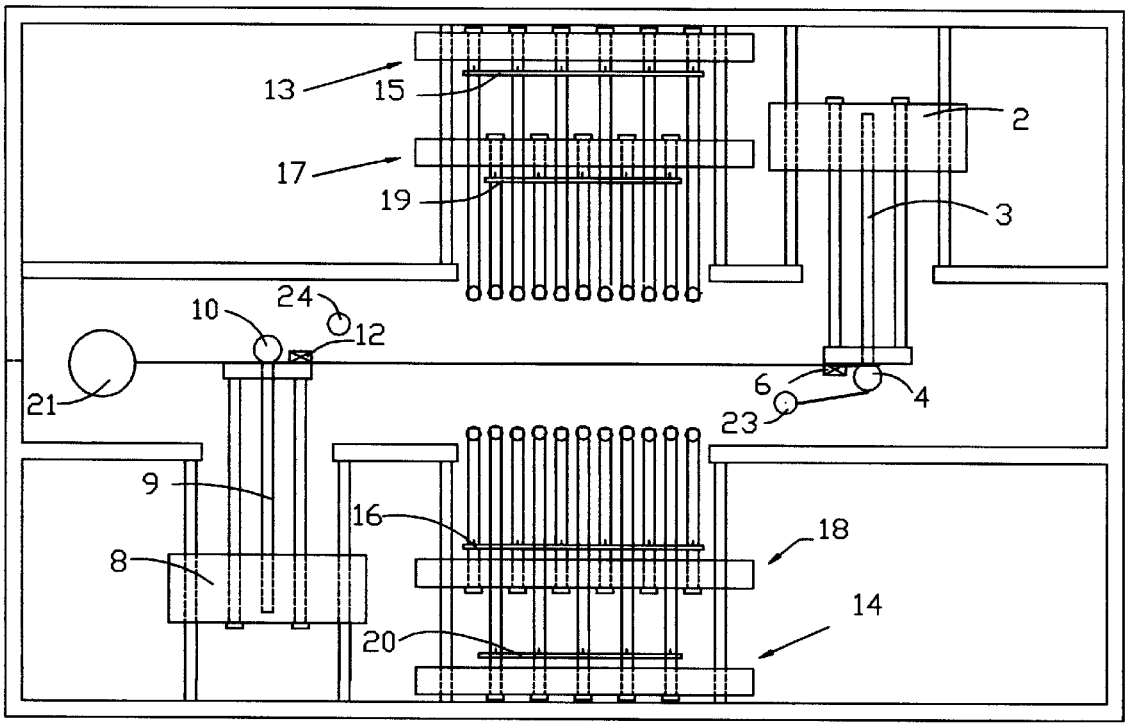
FIG. 2 THROUGH FIG. 5 shows the relative positions of the weaving process during the starting procedure.
Figure 3:
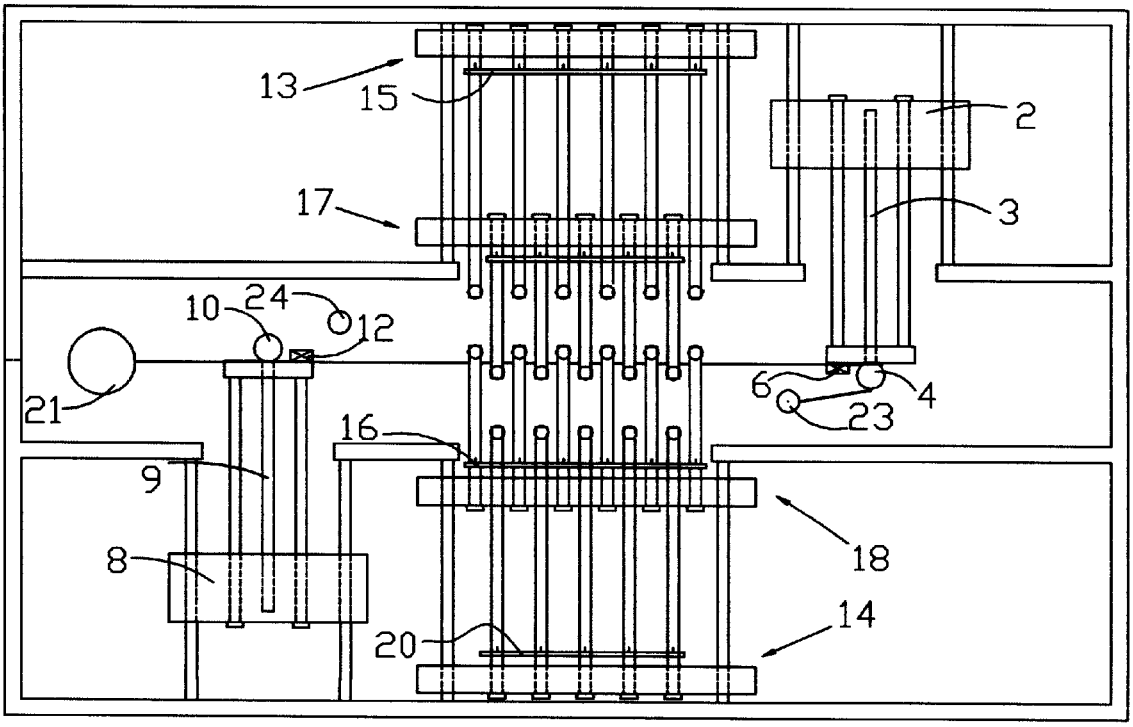
Figure 4:
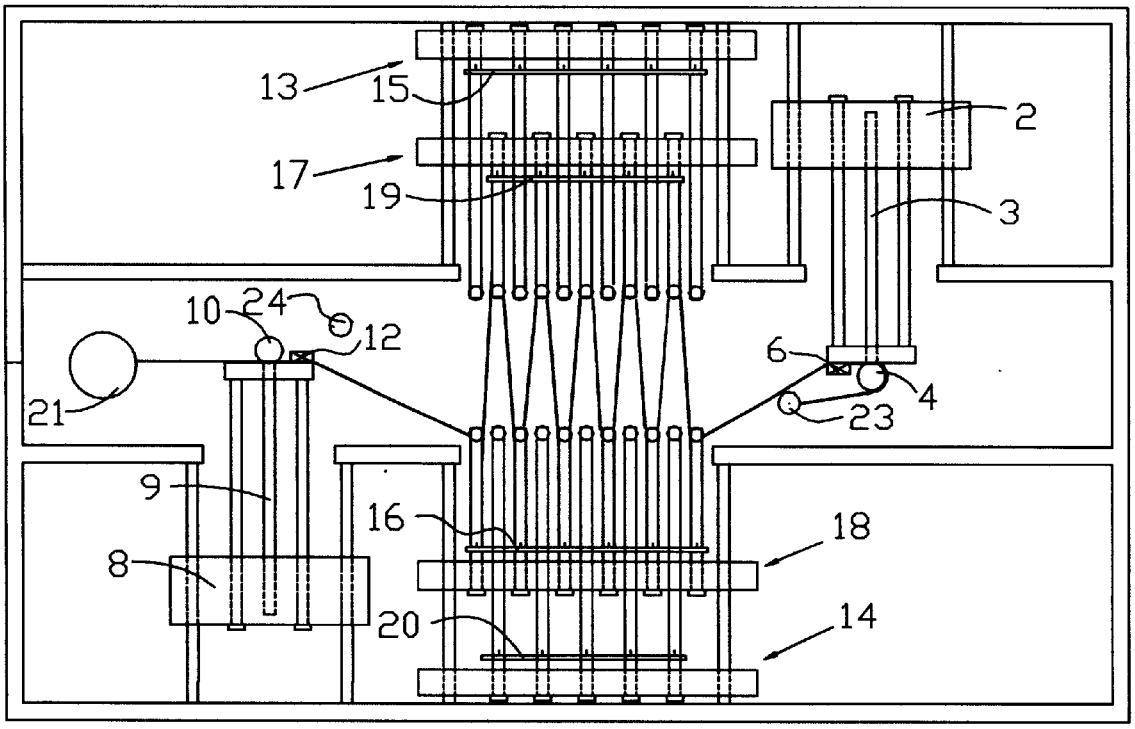

1. Load the bobbin 21 into a bobbin case and place into the west side of the machine.
2. Pull a length of rope out of the bobbin, thread through the west rope end control 8, the east rope end control 2, and then attach to the east holder bar 23. FIG. 2 shows the position of the process at this point.
3. The B set north and south rods 17, 18 move forward to a point where the rope passes past each rods rope regulator 27 and each rods roller 28.
4. The west rope end control 8 moves forward into position to turn the rope and the east rope lock 6 locks the rope from moving.
5. The west rope turner twister 10 turns to a vertical position.
6. The west rope turner pressure clamp 9 moves forward to tighten the rope onto the west rope turner twister 10. FIG. 3 shows the position of the process at this point.
7. The west rope turner twister 10 turns counter clockwise at the same time that the B set north and south rods 17, 18 move backward thus taking up rope which is being pulled out ofthe bobbin 21. FIG. 4 shows the position of the process at this point.
8. The B set north and south rod twisters 16, 19 turn B set north and south rods 17,18 to the side position. This action creates a loop in the section of rope where the bobbin can pass through.

Figure 5:
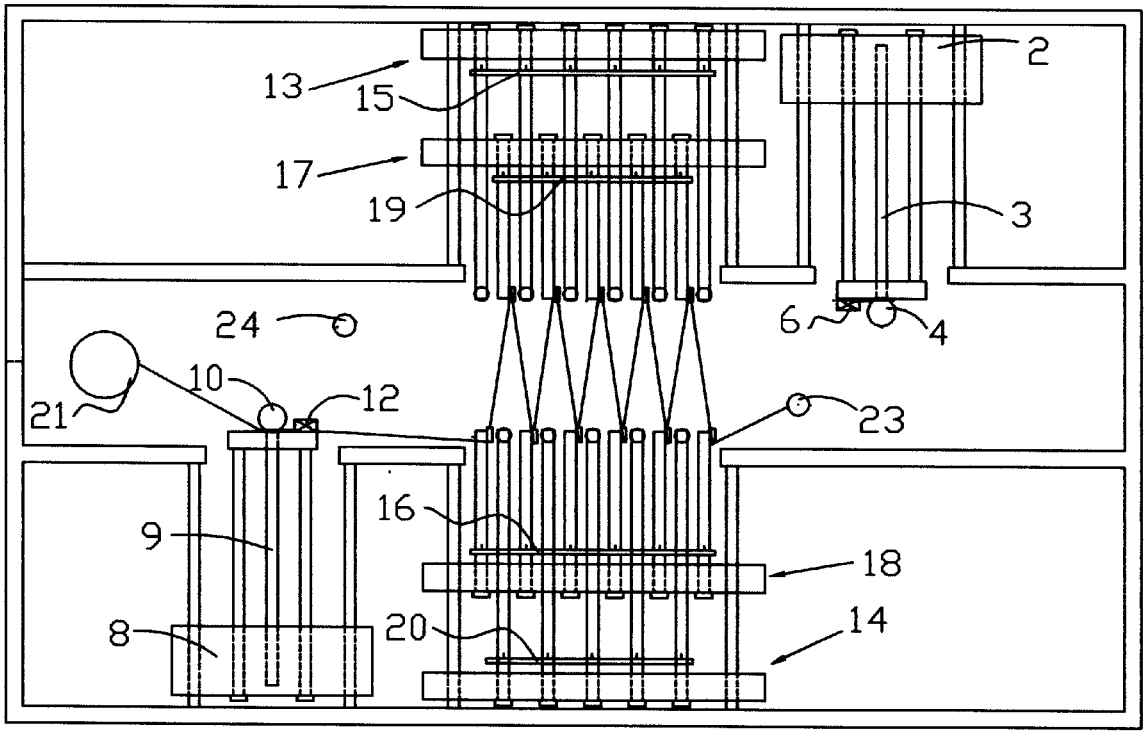

9. The east rope pressure clamp 6 releases the rope, and the east rope turner twister 4 moves to the horizontal position dropping the rope onto the east holding rod 23.
10. The east rope end control 2 moves back past a point at which the bobbin can pass.
11. The west rope end control 8 moves backward with the rope attached to a point at which the bobbin can pass by. FIG. 5 shows the position of the process at this point.

Forward Cycle

Figure 6:
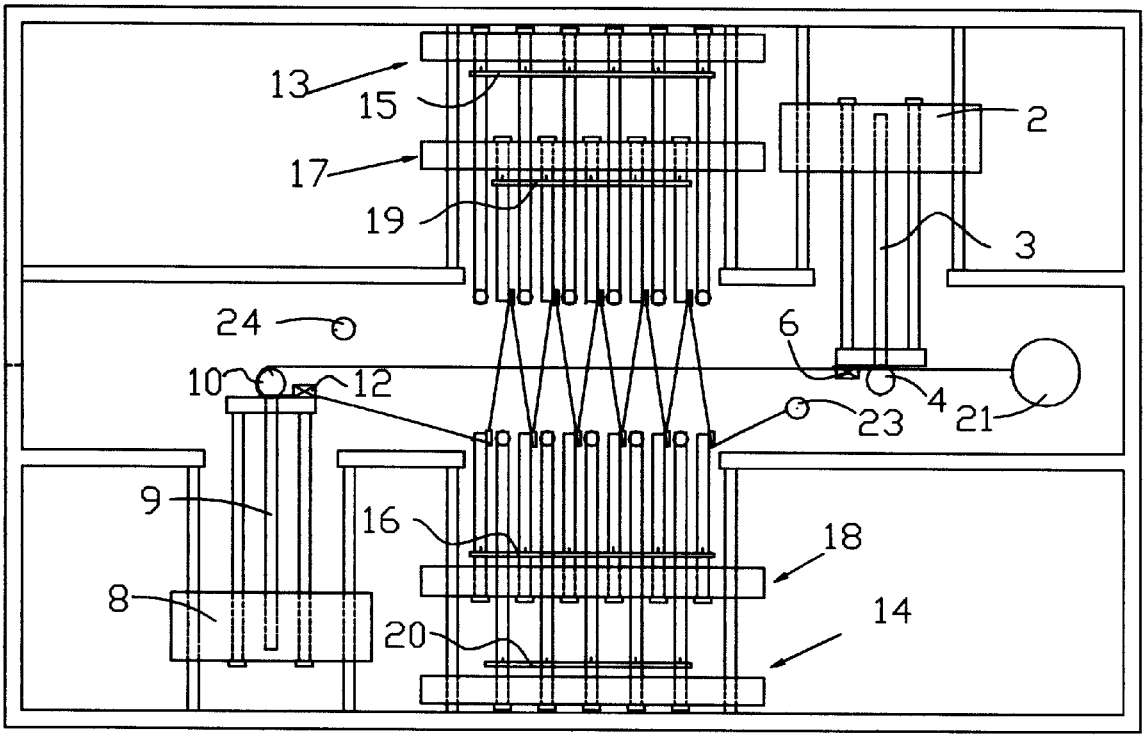
FIG. 6 THROUGH FIG. 11 shows the relative positions of the weaving process during the forward cycle.
Figure 7:
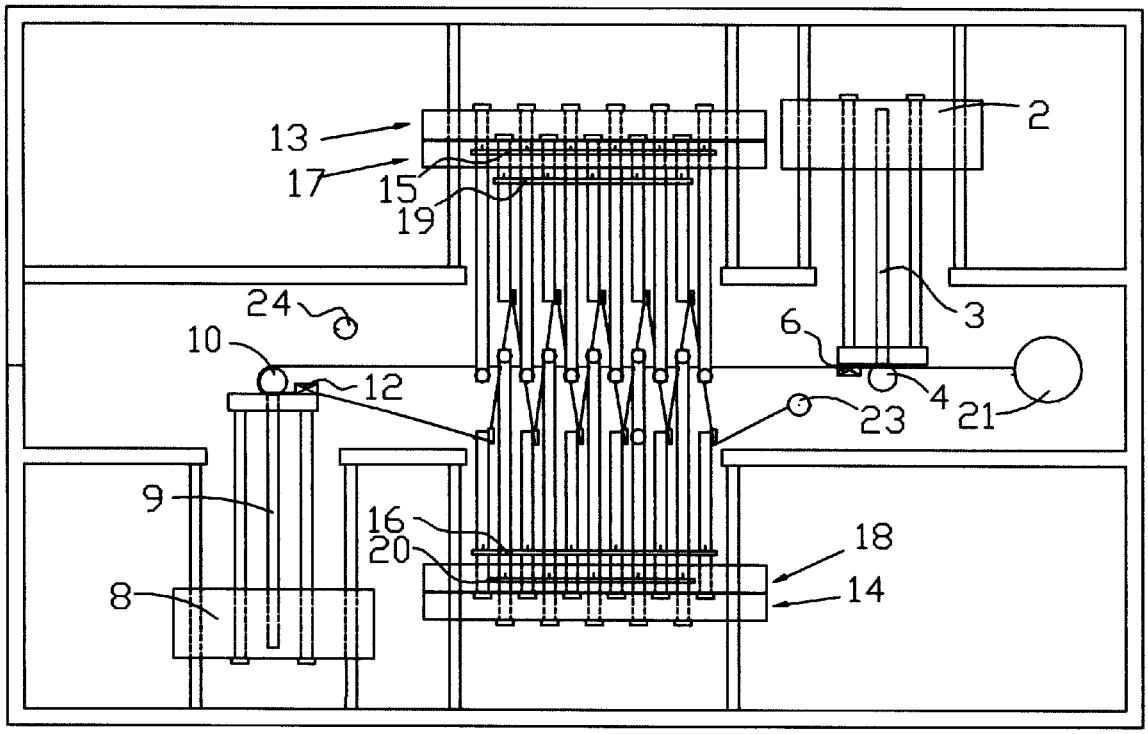
Figure 8:
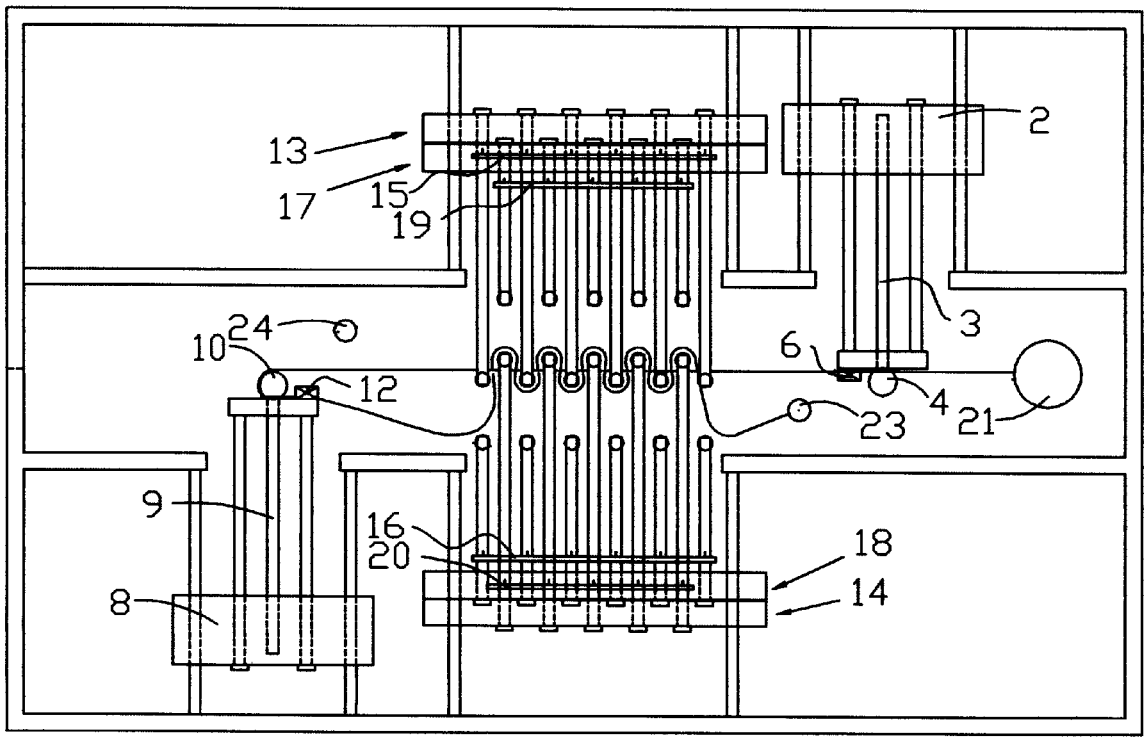
Figure 9:
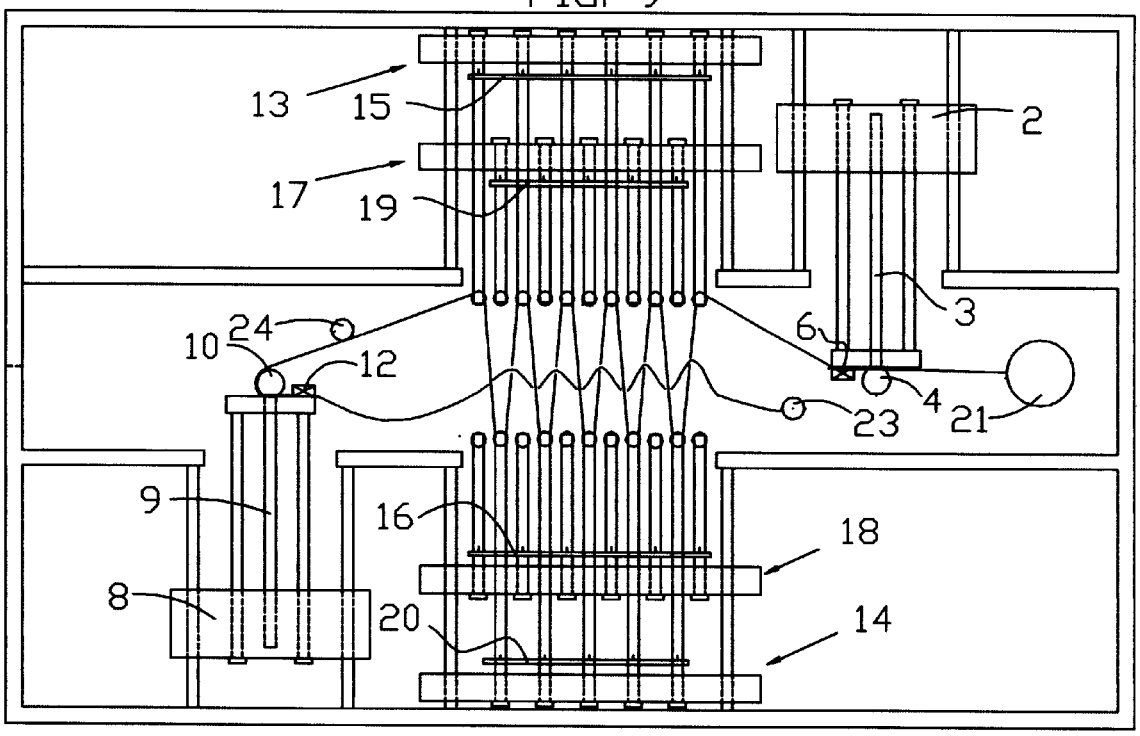
Figure 10:
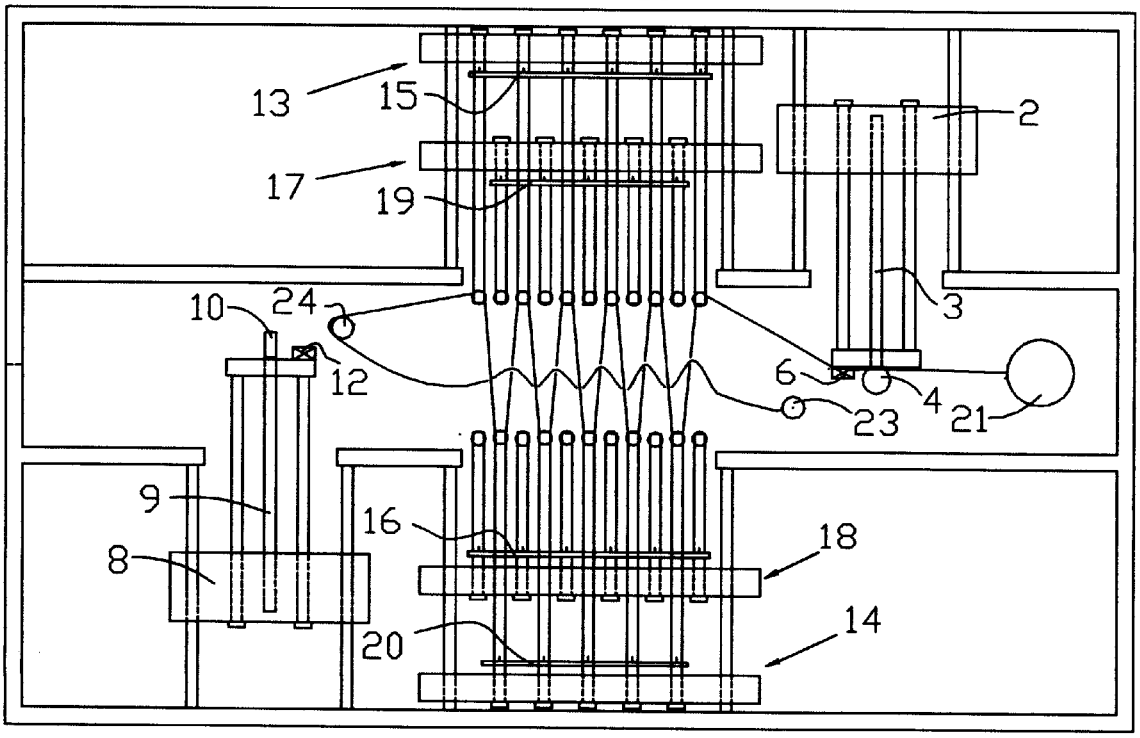
Figure 11:
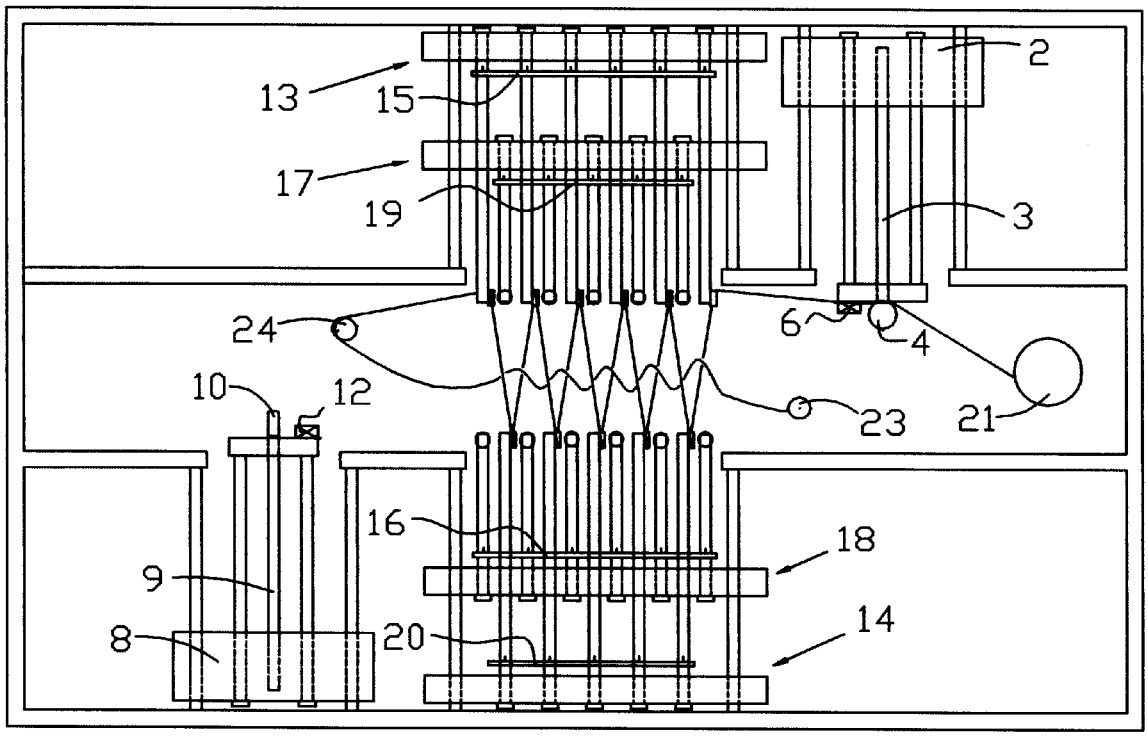

1. The East bobbin puller moves forward and engages the bobbin 21 clamping onto it.
2. The B set north and south rods 17, 18 move forward, which relaxes the weave enough for the bobbin case 21 to be pulled through the opening in the loops of rope.
3. The bobbin 21 is pulled backward through the opening of the ropes and travels all the way to the east side of the weaving machine and stops at its designated spot. FIG. 6 shows the position of the process after this step.
4. The east rope end control 2 moves forward.
5. The east rope turner twister 4 twists to a vertical position.
6. The east rope turner pressure clamp 3 moves forward to tighten the rope onto the east rope turner twister 4.
7. The west rope positioned 8 moves forward to a position to place the rope into a central position.
8. The east rope lock 6 locks the rope on the east side of the machine just in front of the east rope turner twister 4.
9. The west rope turner twister turns counter clockwise to pull the center rope taut. FIG. 6 shows the position after this step.
10. The A set north and south rod twisters 15, 16 turn the A set north and south rods 13, 14 to the down position.
11. The A set north and south rods 13, 14 move forward past the center rope. FIG. 7 shows the position of the process after this step.
12. The A set north and south rods 13, 14 move backward to engage the center rope.
13. The east rope lock 6 unlocks.
14. The east rope turner twister 4 turns counter clockwise at the same time that the A set north and south rods 13, 14 move backward thus taking up rope which is being pulled out ofthe bobbin 21. This movement is the sizing movement and determines the ultimate length of the weave.
15. The B set north and south rods 17, 18 move forward to a predetermined spot as the B set north and south rod twisters 19, 20 turn their respective rods to a down position. This action drops the rope section from this set of rods onto the center rope section
16. The B set north and south rods 17, 18 move all the way backward into position. FIG. 8 shows the position of the process after this step.
17. The B set north and south rod twisters 19, 16 turn the B set north and south rods 17, 18 to the side position.
18. The west rope end control 8 moves forward into position to turn the rope.
19. The east rope lock 6 locks the rope just ahead ofthe east rope turner twister 4 locking it in place.
20. The west rope turner twister 10 turns clockwise at the same time that the A set north and south rods 13, 14 continue to move backward and thus taking up rope which is being pulled from the rope which was previously dropped by the B set north and south rods 17, 18. FIG. 9 shows the position ofthe process after this step.
21. The A set north and south rod twisters 15, 16 turn A set north and south rods 13, 14 to the side position. This action creates a loop in the rope.
22. The west rope turner pressure clamp 9 moves backward to release the rope from the west rope turner twister 10.
23. The west rope lock 12 unlocks the rope
24. The west rope turner twister 10 turns to the horizontal position and thus drops its rope onto the west holder bar 24. FIG. 10 shows the position of the process after this step.
25. The west rope end control 8 moves backward all the way to allow for an opening for the impending bobbin 21 and its case.
26. The east rope end control 2 moves backward all the way to allow for an opening for the impending bobbin 21 and bobbin case. FIG. 11 shows the position of the process after this step.

Backward Cycle

Figure 12:
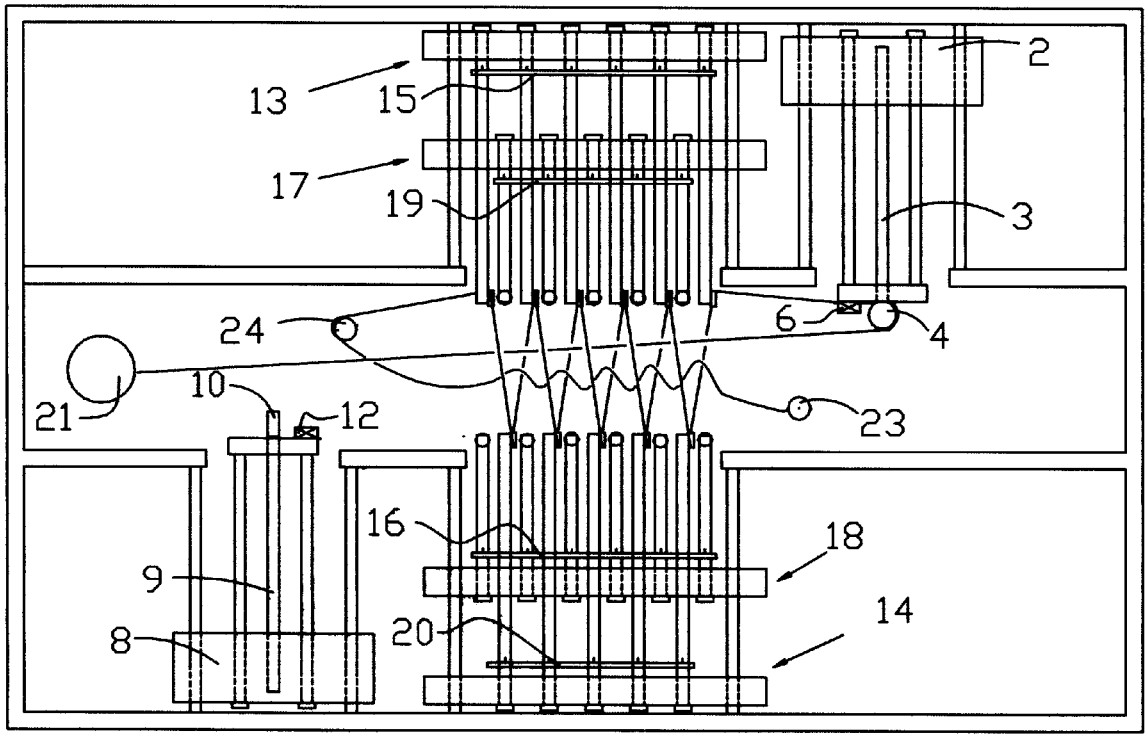
FIG. 12 shows the relative position of the weaving process toward the beginning of the backward cycle.

1. The west bobbin puller moves forward and engages the bobbin 21 with its case.
2. The A set north and south rods 13,14 move forward which relaxes the weave enough for the bobbin 21 and its case to be pulled through the opening.
3. The bobbin 21 and its case are pulled backward through the opening of the ropes and travel all the way to the east side of the weaving machine and stop at its designated spot. FIG. 12 shows the position of the process after this step.
4. The west rope end control 8 moves forward into position to turn the rope.
5. The west rope turner twister 10 twists to a vertical position.
6. The west rope turner pressure clamp 9 moves forward to tighten the rope onto the west rope turner twister 10.
7. The east rope end control 2 moves forward to a position to place the rope into a central position with the weaving machine parts.
8. The west rope lock 12 locks the rope on the west side just in front of the west rope turner twister.
9. The west rope turner twister 10 turns clockwise to pull the center rope tight.
10. The B set north and south rod twisters 19, 20 turn the B set north and south rods 17, 18 to the down position.
11. The B set north and south rods 13, 14 move forward past the center rope
12. The B set north and south rods 13, 14 move backward to engage the center rope.
13. The west rope lock 12 unlocks.
14. The west rope turner twister 10 turns counter clockwise at the same time that the B set north and south rods 17, 18 move backward thus taking up rope which is being pulled out of the bobbin 21. This movement is the sizing movement and determines the ultimate length of the weave.
15. The A set north and south rods 13, 14 move forward to a predetermined spot as the A set north and south rod twisters 15, 16 turn to a down position. This action drops a section of rope from the past set of loops onto the center section of rope.

Figure 14:
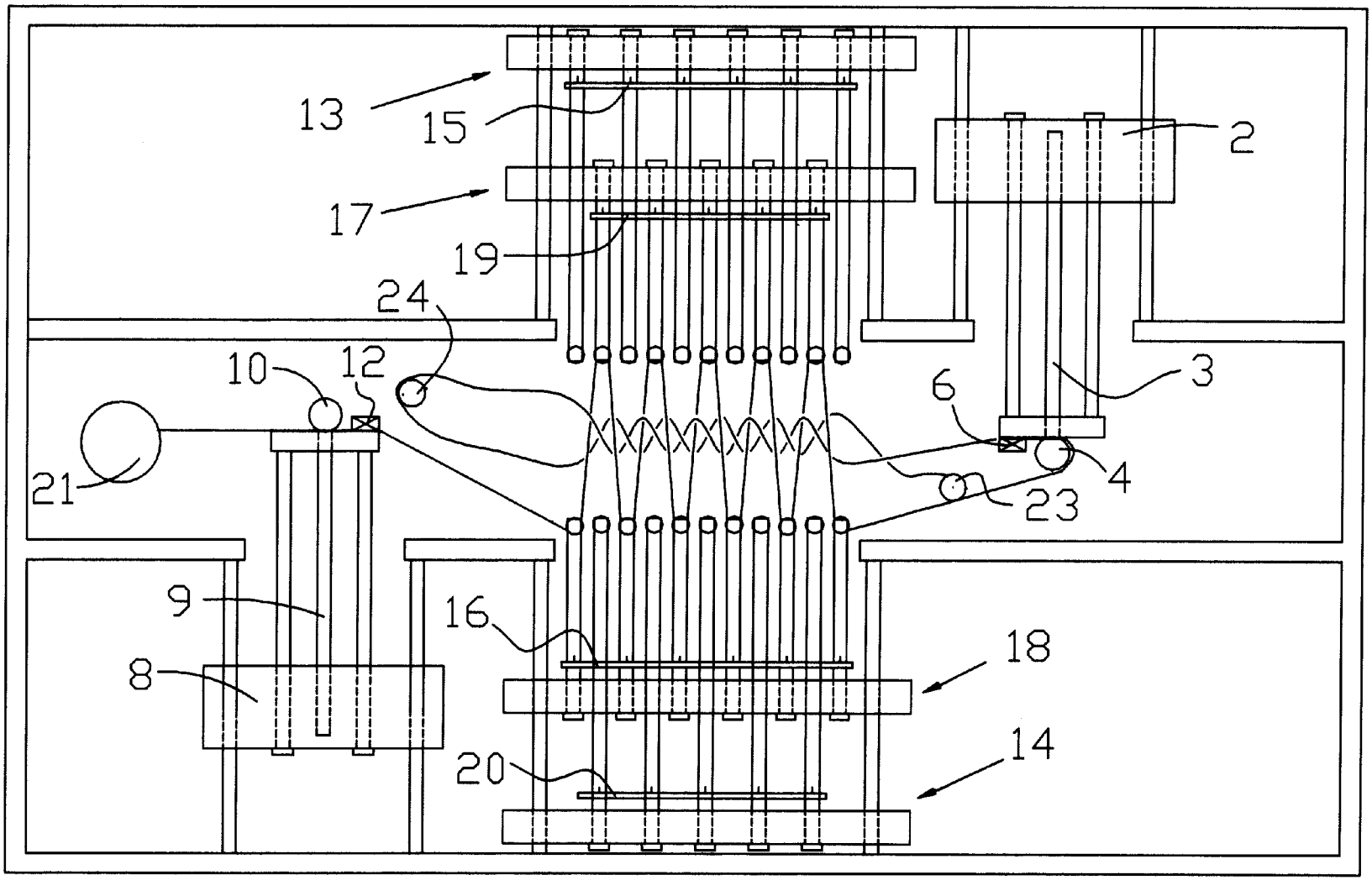
FIG. 14 shows the relative position of the weaving process toward the end of the backward cycle.

16. The A set north and south rods 13, 14 move backward into position.
17. The A set north and south rope twisters 15, 16 turn the A set north and south rods to the side position.
18. The east rope end control 2 moves forward into position to turn the rope.
19. The west rope lock 12 locks the ropejust ahead ofthe west rope turner twister 10 locking it in place.
20. The east rope turner twister 4 turns clockwise at the same time that the B set north and south rods 17, 18 continue to move backward and thus taking up rope which is being pulled from the rope which was previously dropped by the A set north and south rods 13, 14. FIG. 14 shows the position of the process after this step.
21. The B set north and south rod twisters 19, 20 turn B set north and south rods 17,18 to the side position. This action creates a loop in the rope.
22. The east rope turner pressure clamp 3 moves backward to release the rope from the east rope turner twister 4.
23. The east rope lock 6 unlocks the rope.
24. The east rope turner twister 4 turns to the horizontal position and thus drops its rope onto the east holder bar 23.
25. The east rope end control 2 moves backward all the way to allow for an opening for the impending bobbin 21 and its case.
26. The west rope end control 8 moves backward all the way to allow for an opening for the impending bobbin 21 and its case.

Removing Procedure

1. The A set north and south rods 13, 14 move forward to a predetermined spot as the A set north and south rod twisters 15, 16 turn the A set north and south rods to the down position. This action drops the rope from the past set of loops.
2. Any extra rope is pulled out of the bobbin.
3. The holder bars 23, 24 are removed with the hammock bed attached
4. New holder bars are placed in position to start a new bed.

I claim:

1. A method of making a woven, open mesh pattern from one continuous rope or like material comprising the steps of:

a. providing said rope on a circular bobbin, and b. passing said bobbin along a central path leaving a section of said rope along said path, c. providing two sets of rods, each set comprising rods which are situated in opposing and alternating relationship to the other set of rods, and d. providing circular capturing devices at the ends of said rods, and e. passing of the first set of said rods over said rope to capture it, and f. pulling said rods back and turning them to form a tube of rope, g. providing end controls to hold said rope, and h. passing said bobbin through the center of the said tube of rope, and i. pulling the said rope by means of said end controls into the predetermined size, and j. turning said rods to original position to drop the said rope into holding rods, and k. passing second said set of rods over said center rope and repeating e through j as many time as desired.

* * * * *